United States Patent [19]

Sakata et al.

[11] Patent Number: 4,731,131

[45] Date of Patent: Mar. 15, 1988

[54] METHOD OF SUBJECTING WELDED STRUCTURE TO HEAT TREATMENT

[75] Inventors: Shinji Sakata, Katsuta; Tasuku Shimizu, Hitachi; Kunio Enomoto, Ibaraki; Hirotsugu Fujimoto, Hitachi, all of Japan

[73] Assignee: Hitachi, Ltd., Tokyo, Japan

[21] Appl. No.: 817,669

[22] Filed: Jan. 10, 1986

[30] Foreign Application Priority Data

Jan. 23, 1985 [JP] Japan ..... 60-8996

[51] Int. Cl.[4] ..... C21D 9/08

[52] U.S. Cl. ..... 148/127; 148/154

[58] Field of Search ..... 148/127, 154

[56] References Cited

U.S. PATENT DOCUMENTS 4,229,235 10/1980 Matsuda et al. ..... 148/127

*Primary Examiner*—R. Dean

*Attorney, Agent, or Firm*—Antonelli, Terry & Wands

[57] ABSTRACT

A method of subjecting a welded structure to heat treatment in which a tensile yield is produced on an inner surface of the welded structure and a compressive yield is produced on an outer surface of the welded structure by the steps of placing a cooling medium in the interior of the welded structure and heating the outer surface of the welded structure to cause a difference in temperature to exist between the inner surface and other surface of the welded structure. The method further includes the step of locally heating a weld by means of a heating member to improve residual stress in a localized area of the weld and repeating the improvement of the residual stress regarding another localized area of the weld.

6 Claims, 15 Drawing Figures

METHOD OF SUBJECTING WELDED STRUCTURE TO HEAT TREATMENT

BACKGROUND OF THE INVENTION

This invention relates to methods of subjecting welded structures to heat treatment, and, more particularly, to a method of subjecting pipes, cylindrical vessels and other structures of large size in nuclear power plants, chemical plants, etc., to heat treatment, which is suitable for improving the residual stress occurring on the inner surface of these structures by welding.

It has been proposed to rely on heat treatment to improve the residual stress occurring on the inner surface of a welded structure by welding in, for example, in U.S. Pat. No. 4,229,235 however, no consideration has, been given to welded structures of large size in which difficulty is encountered in subjecting the whole of each weld to heat treatment by using a single heating member.

OBJECT OF THE INVENTION

This invention has as its object the provision of a method of subjecting a welded structure of large size, such as a pipe, a cylindrical vessel, etc., in a nuclear power plant, a chemical plant and the like, to heat treatment to improve the residual stress occurring on the inner surface thereof by welding which heat treatment has been difficult to improve with regard to the whole of each weld by using a single heating member, due to the large size of the structures to be treated.

SUMMARY OF THE INVENTION

To accomplish the aforesaid object, the invention provides a method of subjecting a welded structure to heat treatment by heating the outer surface of the welded structure to cause a difference in temperature to exist between the inner surface and outer surface of the welded structure to produce both tensile yield of the inner surface and a compressive yield of the outer surface, and locally heating a weld to relieve stress. The stress is partially improved as a localized area of the weld is heated, and a heating member is successively moved to areas where the stress has not been relieved, or a plurality of heating members are arranged along the weld to relieve the stress occurring in the weld of large length of the welded structure of large size.

When the heating member is high in temperature to cause thermal deformation at end portions of the heating member, the improvement of the stress can be achieved by reducing the heat generation at each end portion of the heating member below the heat generation at the central portion thereof. The amount of heat generated at each end portion extending in the range of $\frac{1}{8}\cdot L-\frac{1}{3}\cdot L$ (L is the length of the heating member) of the heating member is reduced preferably in the range between 50 and 85% of the amount of heat generated by the central portion thereof. When the area of reduced heat generation is greater in length than $\frac{1}{3}\cdot L$, operation efficiency is reduced because the area of reduced heat generation becomes too great in length. Conversely, when the area of reduced heat generation is smaller than $\frac{1}{8}\cdot L$, the effects achieved in preventing the thermal deformation of the heating member are reduced. When the reduced heat generation is over 85%, the effects achieved in preventing the thermal deformation of the heating member are reduced, and, when the reduced heat generation is below 50%, the operation efficiency drops because of low temperature at which heating is carried out.

DETAILED DESCRIPTION

Figure 1:
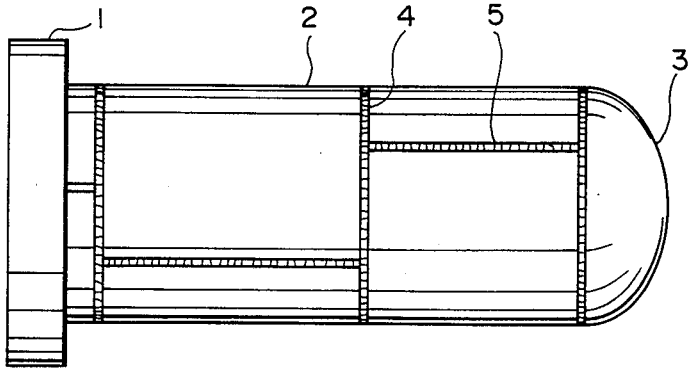
FIG. 1 is a schematic view of a vessel of substantially cylindrical configuration in which the method according to the invention is applicable.

Referring now to the drawings wherein like reference numerals are used throughout the various views to designate like parts and, more particularly, to FIG. 1, according to this figure, a vessel of substantially cylindrical configuration suitable for carrying the method according to the invention into practice is shown as an example of a structure of large size in which difficulty has been experienced in the prior art in heating the whole of a weld by using a single heating member. As shown in FIG. 1, the vessel comprises a flange 1, a cylindrical shell 2 and an end plate 3 which are joined together by circumferential welds 4 and axial welds 5.

Figure 2:
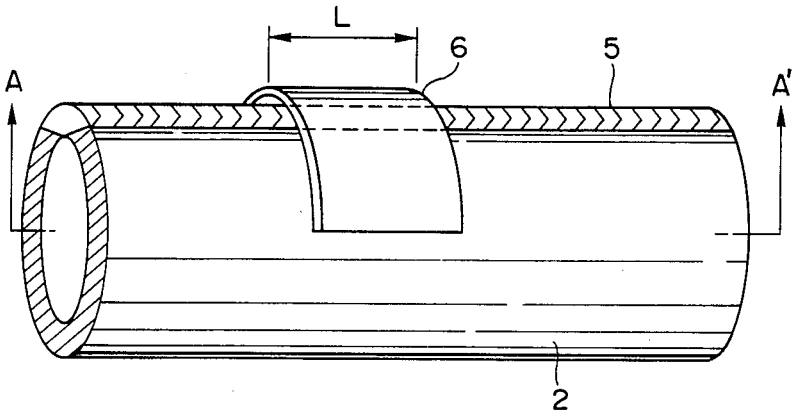
FIG. 2 is a perspective view of one embodiment of the invention.
Figure 3:
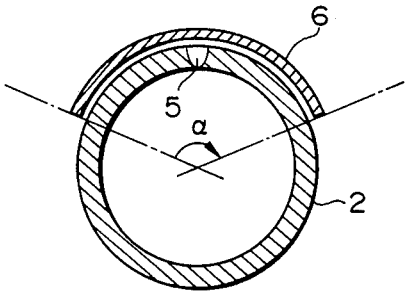
FIG. 3 is a cross-sectional view of the embodiment of FIG. 2.

FIGS. 2 and 3 are views in explanation of one embodiment of the invention in which a heating member 6, having a length L and comprising high frequency induction heating coils is located along the weld 5. In the embodiment of FIGS. 2 and 3, the heating member 6 heats, by high frequency-induction-heating, a localized area of the weld 5 for a predetermined period of time to improve stress in this localized area. Then, the heating member 6 is successively moved to areas where stress has not yet been improved, until the stress in the whole of the weld 5 is improved. The vessel contains therein a cooling medium such as, for example, water, and the heating member 6 has external dimensions which satisfy the following relationship:

$$L \geqq 2.7\sqrt{Rt} \quad (1)$$

$$\alpha \geqq 120^\circ \quad (2)$$

where

L: the length of the heating member 6;

R: the mean radius of the vessel of substantially cylindrical configuration (having different radii at the opposite ends);

$\alpha$: the angle formed by a line connecting the axis of the vessel to one side end of the heating member 6 and a line connecting the axis of the vessel to the opposite side end of the heating member 6; and t: a thickness of the wall of the welded structure.

In embodiment of FIGS. 2 and 3, the heating member 6 is moved. Thus, even if the weld 5 has a great axial length because of the large size of the vessel, residual stress can be improved without any technical limitations being placed on the operation, to improve the resistance of the welded structure to stress corrosion.

Figure 4:
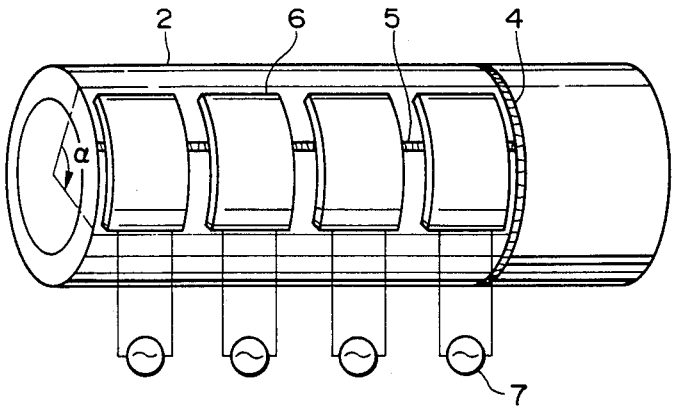
FIG. 4 is a perspective schematic view of another embodiment of the invention.

FIG. 4 shows another embodiment of the invention in which a plurality of heating members 6 are located on the weld 5. The heating members 6 may be arranged with a predetermined spaced interval provided between the adjacent heating members 6. Alternatively, the heating members 6 may be arranged with opposite end portions thereof overlapping each other or without overlapping. Each heating member 6 is connected to a power source 7, and the heating members 6 are rendered operative to heat the weld 5, either simultaneously or successively.

In the embodiment shown in FIG. 4, the need to move the single heating member 6 after the operation of heating each localized area of the weld 5 is finished is eliminated, so that the heating operations can be readily performed.

Figure 5:
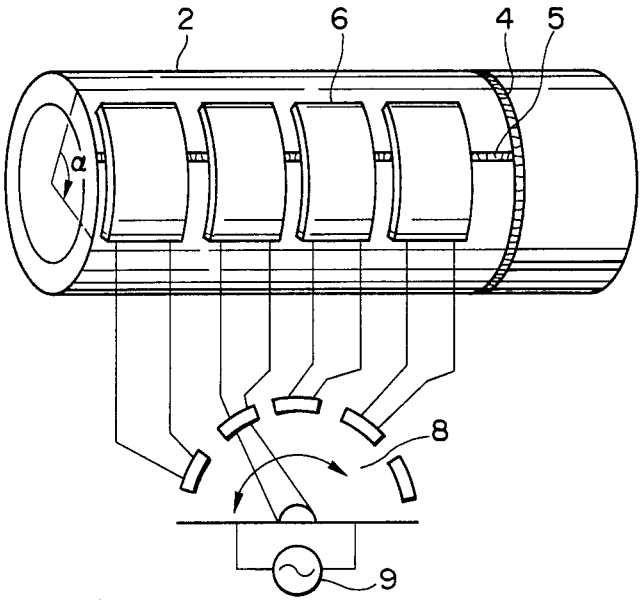
FIG. 5 is a schematic perspective view of still another embodiment of the invention.

FIG. 5 shows still another embodiment of the invention which is similar to the embodiment shown in FIG. 4 but distinct therefrom in that a single power source 9 is provided, in place of the plurality of power sources 7 in the embodiment shown in FIG. 4. The heating members 6 of the embodiment of FIG. 5 are connected to the power source 9 via a switch 8 which is actuated when the weld 5 is heated.

In the embodiment shown in FIG. 5, the use of the single power source 9 offers the advantage that the installation costs are lower than in the embodiment of FIG. 4.

Figure 6:
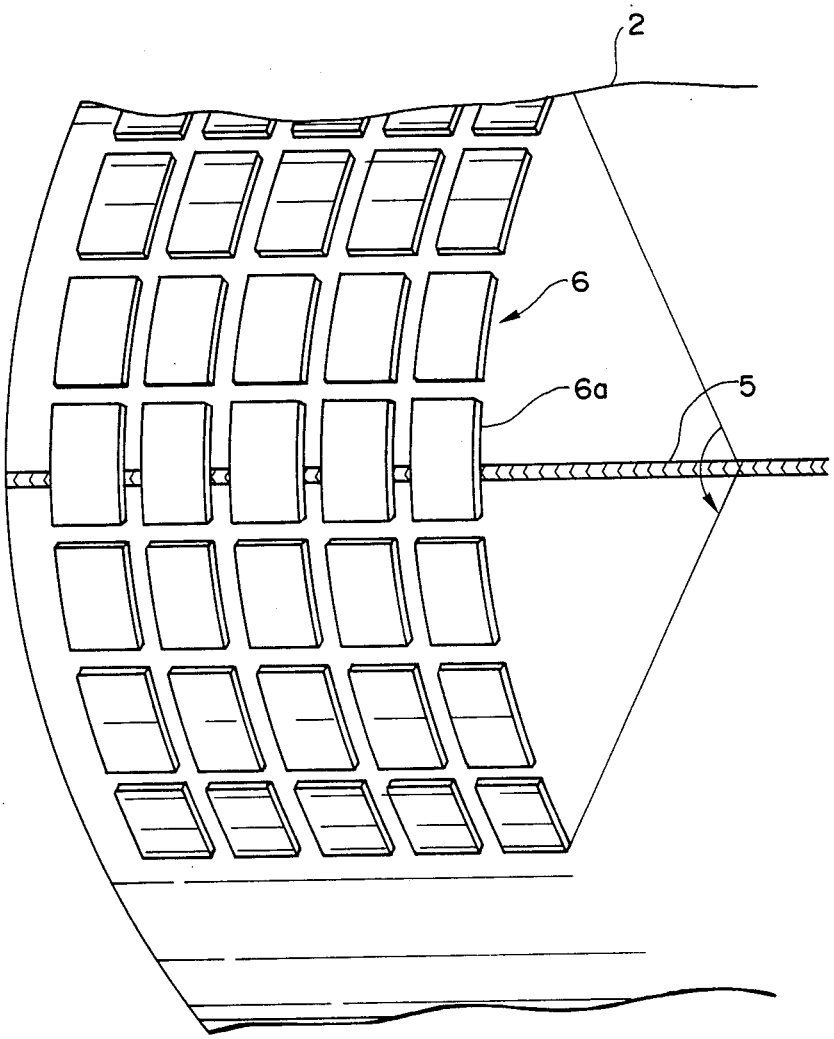
FIG. 6 is a schematic perspective view, on an enlarged scale, of still another embodiment of the invention.

In FIG. 6, the heating member 6 is split into a plurality of segments 6*a*. The heating member 6 of the embodiment of FIG. 6 has external dimensions which also satisfy the equations (1) and (2). The relationship between the heating member 6 and weld 5 in position is such that the position of the whole of the heating member may deviate in a circumferential extent of $\pm 15^\circ$ with respect to the axial center line of the weld 5.

The embodiment shown in FIG. 6 offers the advantage that the residual stress relieving operation can be performed regardless of the configuration of the hollow vessel. This improves the precision with which the heating member 6 is set in position and increases the versatility of the method according to the invention.

Figure 7:
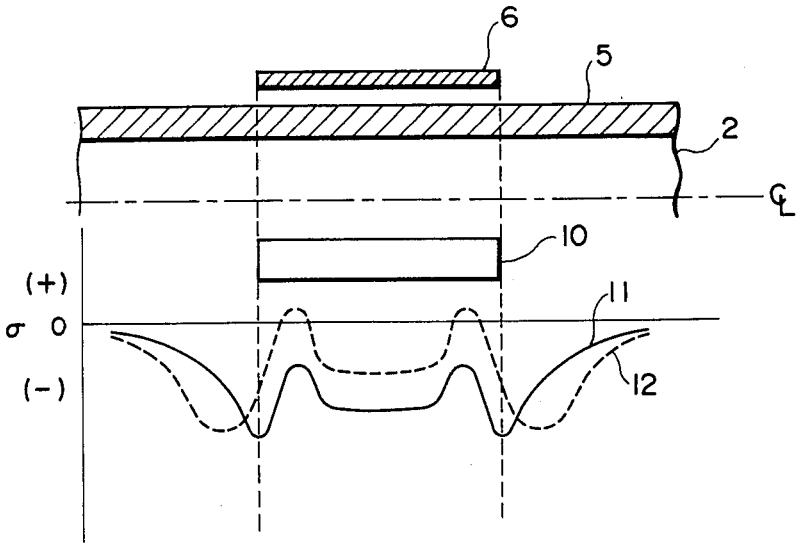
FIG. 7 is a graphical illustration of a distribution of residual stress which has been improved when the heat generated by the heating member is uniformly distributed.
Figure 8:
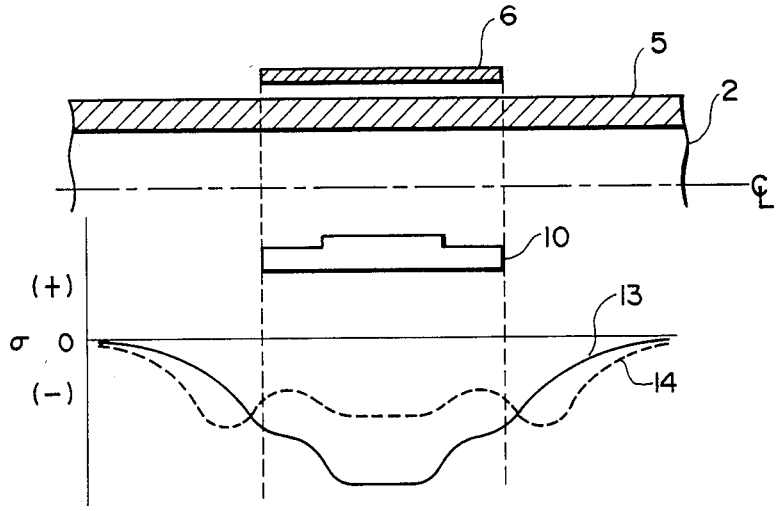
FIG. 8 is a graphical illustration of a distribution of residual stress which has been improved when the heat generation at each end portion of the heating member is smaller than the heat generation at the central portion of the heating member.

FIGS. 7 and 8 are diagrams each showing a heat generation distribution 10 and a stress distribution obtained after the stress is relieved by the method according to the invention in a section taken along the line A—A' in FIG. 2 (+ indicates a tensile stress, and − indicates a compressive stress). FIG. 7 shows the relationship between the heat generation distribution and stress distribution obtained when the heat generation of the heating member 6 was uniform, and FIG. 8 shows the corresponding relationship obtained when the heat generation at the opposite ends of the heating member 6 was reduced below the heat generation at the central portion thereof. As can be clearly seen in FIG. 7, marked effects were achieved by the method according to the invention in improving residual stress with regard to a circumferential residual stress 11 when the heat generation was uniform. However, no satisfactory results were achieved in improving an axial residual stress 12 due to the thermal deformation of the heating member 6.

FIG. 8 illustrates the relationship between the heat generation distribution and stress distribution obtained when the heat generation at each end portion defined by $\frac{1}{4}\cdot L$ of the heating member 6 was reduced to 75% of the heat generation of the central portion of the heating member 6 by providing a large space between adjacent induction heating coils. As shown in FIG. 8, the method according to the invention achieves advantageous effects in improving residual stress with regard to both a circumferential residual stress 13 and an axial residual stress 14 which had become compressive stresses.

Figure 9:
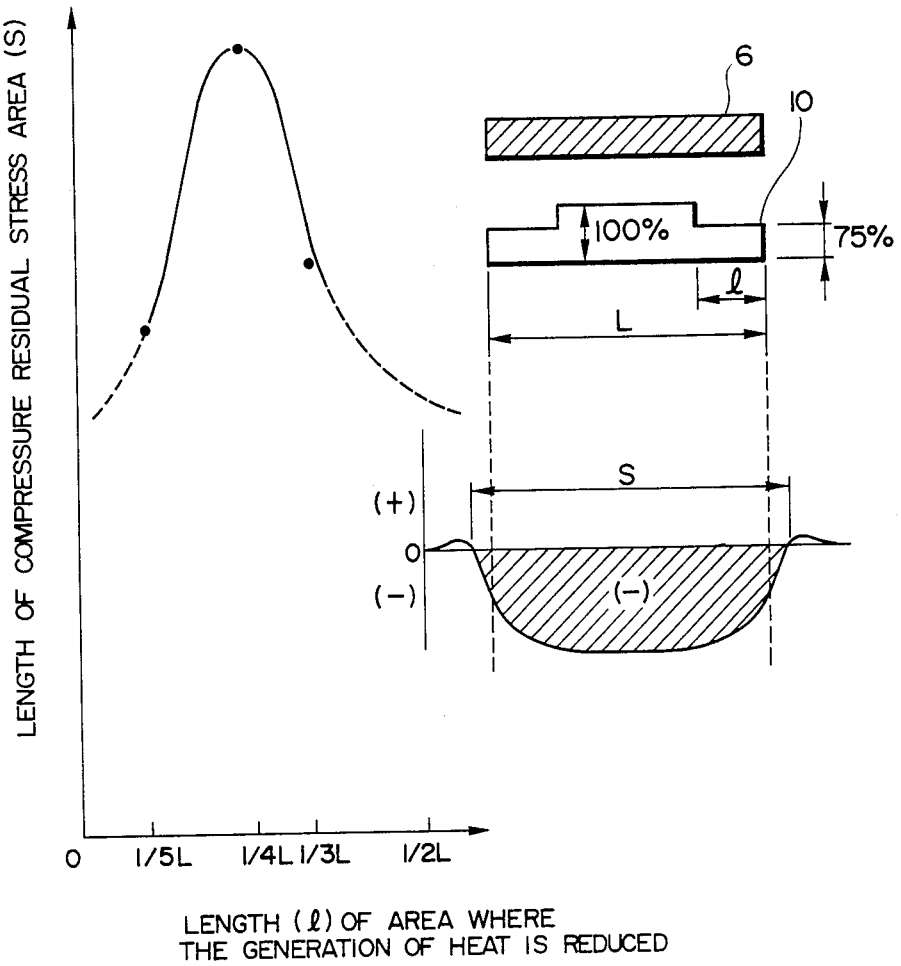
FIG. 9 is a graphical illustration of the length of the area of relieved compressive residual stress with respect to changes made in the length of the reduced heat generation area at each end portion of the heating member.

FIG. 9 shows the relationship between the length l of the end portions of the heating member 6 having a heat generation distribution 10 in which the end portions have a reduced heat generation rate of 75% and the length S of a compressive residual stress zone in which the stress has been improved. It is shown that the compressive residual stress zone had its length S maximized when the length l of each reduced heat generation end portion was $\frac{1}{4}\cdot L$, showing the greatest effects in improving the stress.

Figure 10:
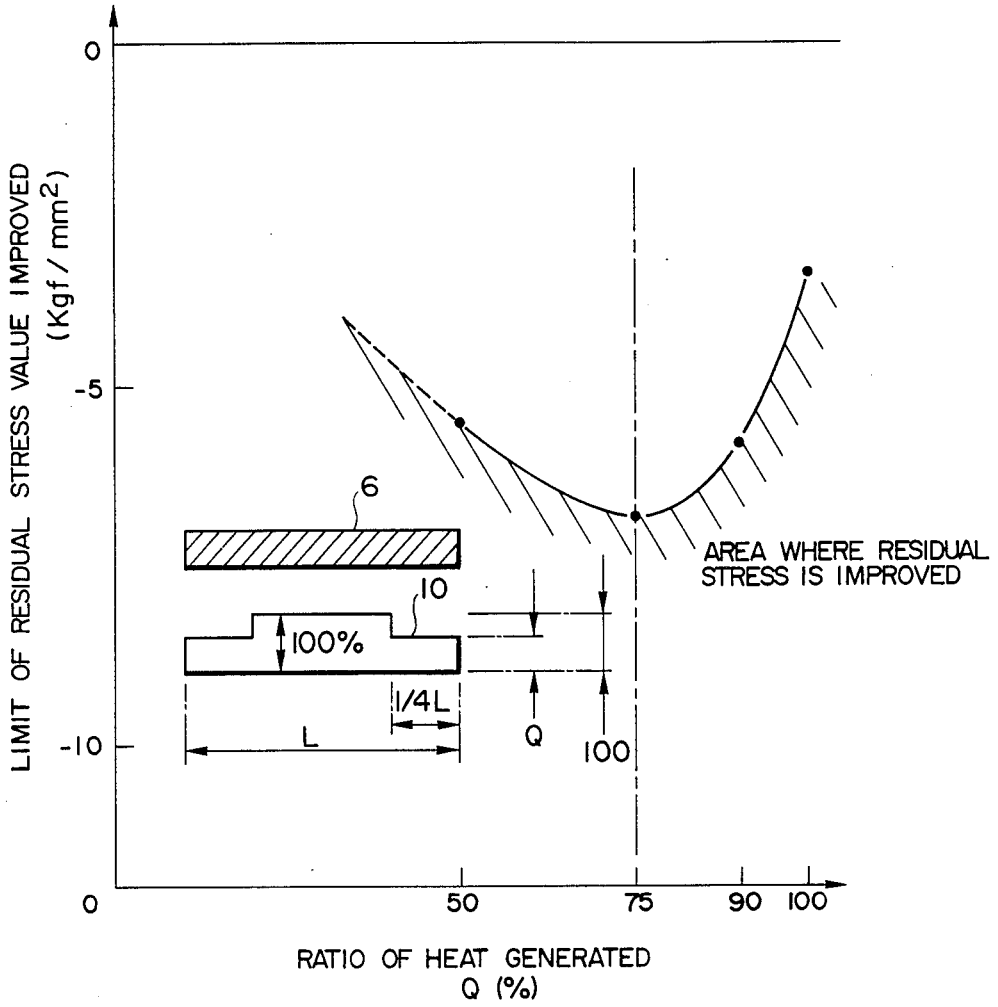
FIG. 10 is a graphical illustration of the values of improved compressive residual stress with respect to the generated specific heat Q obtained when the heat generation at the reduced heat generation area at each end portion of the heating member set at $\frac{1}{4}\cdot L$ is reduced below the heat generation at the central portion of the heating member.

FIG. 10 is an illustration showing a marginal improved stress (a stress at each opposite end of the heating member 6) determined by varying the generated specific heat Q of the end portions of the heating member 6 with respect to the central portion thereof when the heating member 6 having at each end portion a reduced heat generation area of a length l which is $\frac{1}{4}\cdot L$ had a heat generation distribution 10 in which the reduced heat generation was varied. As clearly shown in FIG. 10, the effects achieved by the method according to the invention are maximized when the generated specific heat Q was 75%.

Figure 11:
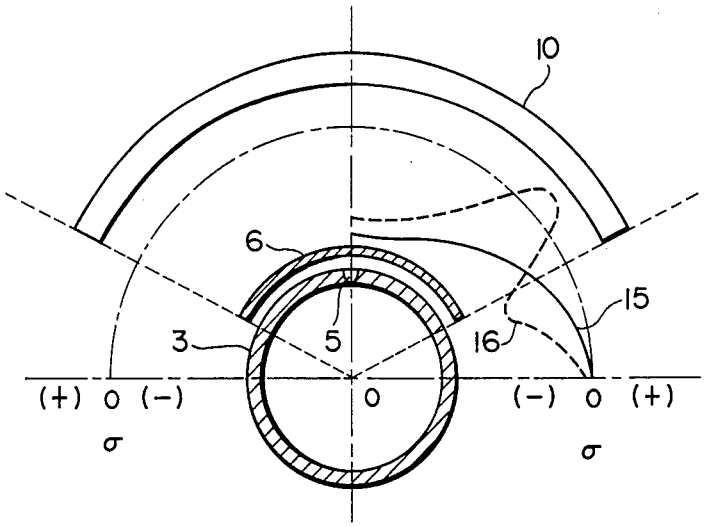
FIG. 11 is a graphical illustration of a distribution of residual stress obtained when the heating member has a uniform distribution of heat generation.
Figure 12:
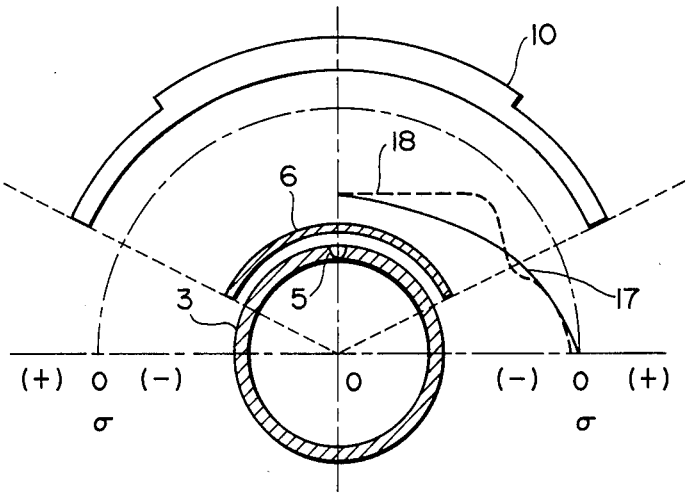
FIG. 12 is a graphical illustration of a distribution of residual stress obtained when the hear generation at each end portion of the heating member is reduced.

FIGS. 11 and 12 each show a residual stress distribution obtained when the heating member 6 had a circumferential heat generation distribution 10. As shown in FIG. 11, when the heat generation of the heating member 6 was uniform, the method according to the invention achieves advantageous effects in improving stress with regard to an axial residual stress 15, and no satisfactory effects are achieved in improving stress with regard to a circumferential residual stress 16. As shown in FIG. 12, when the heat generation of each end portion $\frac{1}{4}\cdot L$ of the heating member 6 was reduced to 75% of the central portion thereof, the method according to the invention achieved advantageous effects in improving stress with regard to both an axial residual stress 17 and a circumferential residual stress 18.

Figure 13:
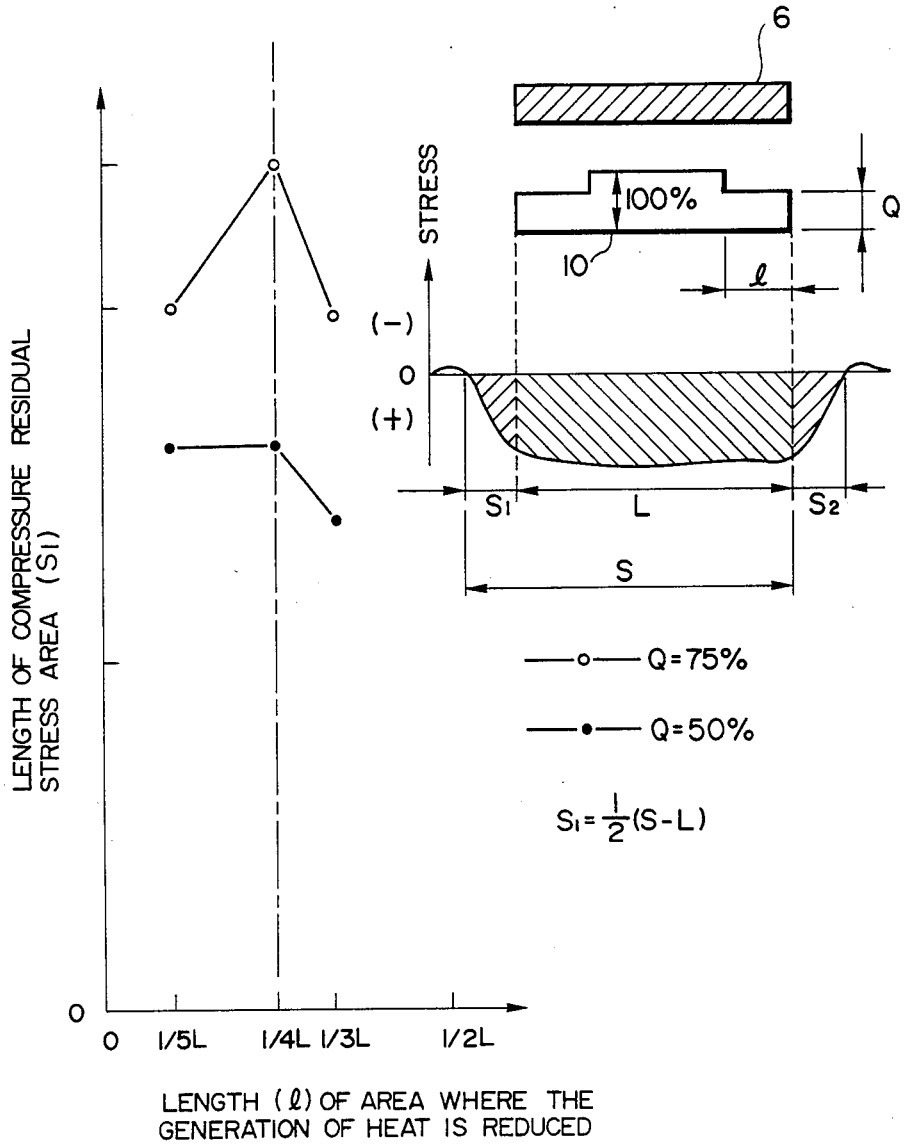
FIG. 13 is a graphical illustration of the length of the area of improved compressive residual stress with respect to changes made in the length of the reduced heat generation area at each end portion of the heating member.

By optimizing the overlapping of the end portions of the heating member 6, it is possible to reduce the period of time required for subjecting the weld to heat treatment by the method according to the invention. FIG. 13 shows the relationship between the length $S_1$ ($S_1=\frac{1}{2}(S-L)$) of the weld from each end of the heating member 6 having a heat generation distribution 10 to the compressive residual stress area and the length l of the reduced heat generation area by using the generated specific heat Q as a parameter. As shown in FIG. 13, the operation efficiency is maximized when the length l of the reduced heat generation area is $\frac{1}{4}\cdot L$ and the generated specific heat Q is 75%. The successive positions of the heating member 6 may be separated from each other by a distance corresponding to the lenth $S_1$ at a maximum. When the maximum distance, covered by the movement of the heating member 6, is expressed as a function of the mean radius R and the wall thickness t of the cylindrical vessel, it can be approximately expressed by $S_1 \approx \sqrt{Rt}$.

Figure 14:
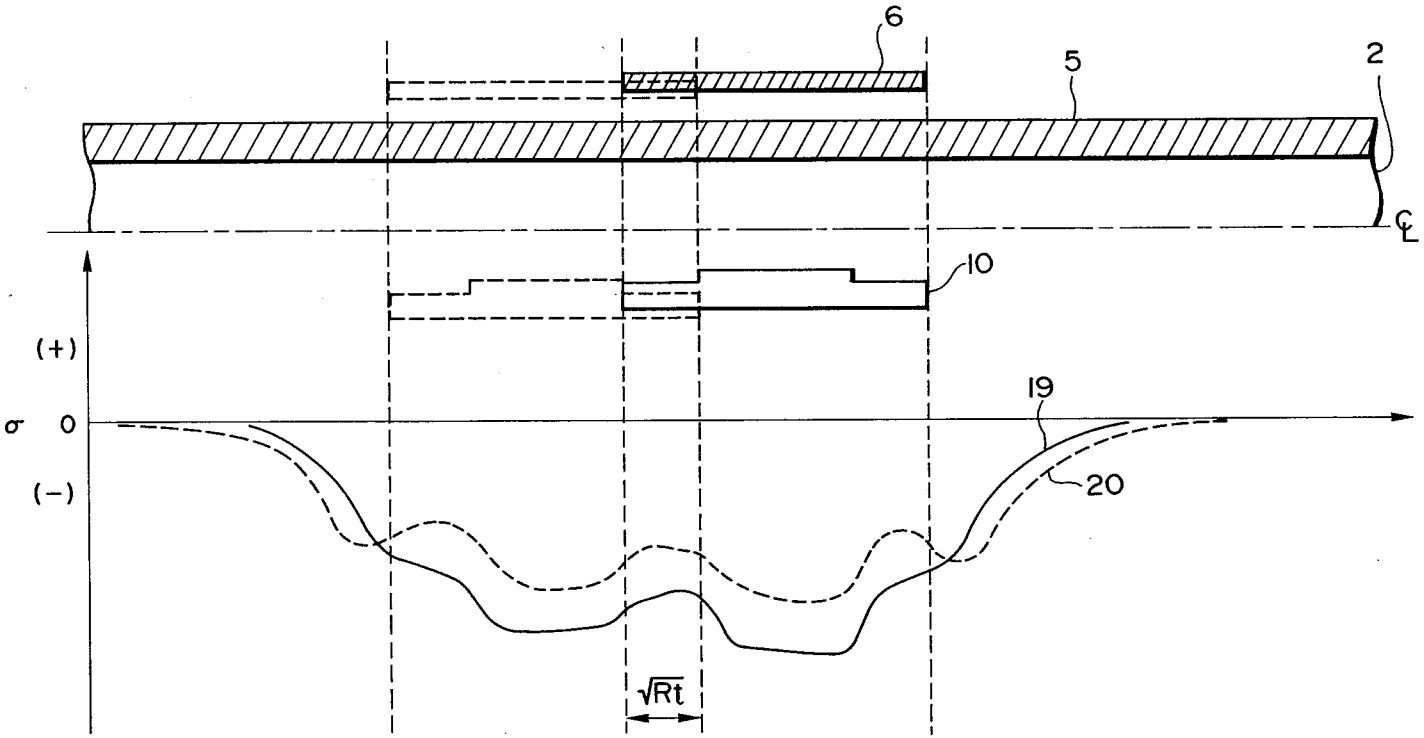
FIG. 14 is a graphical illustration of a distribution of residual stress obtained when the end portions of the heating members are superposed one over the other a suitable distance before and after the movement of the heating member.

FIG. 14 shows a residual stress distribution which was obtained when the end portions of the heating member 6 having a reduced heat generation rate of 75% at each end portion of $\frac{1}{4}\cdot L$ had an overlapping allowance of Rt. It was seen that both an axial residual stress 19 and a circumferential residual stress 20 have become compressive stresses, indicating that the method according to the invention has improved effects and a high reliability.

Figure 15:
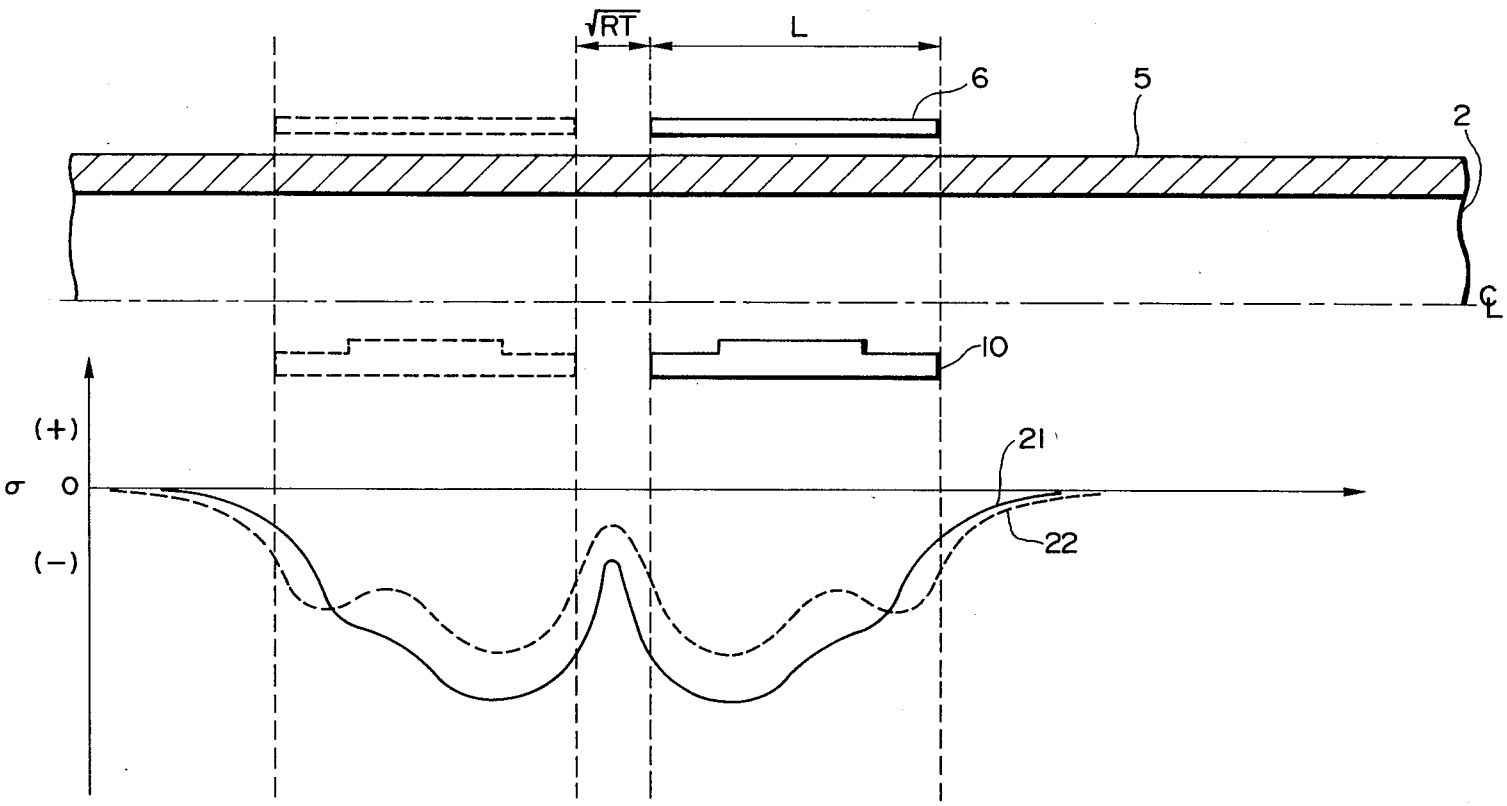
FIG. 15 is a graphical illustration of a distribution of residual stress obtained when the end portions of the heating members are spaced apart from each other a maximum distance before and after the movement of the heating member.

FIG. 15 shows a residual stress distribution obtained when the distance covered by the movement of the heating member 6 was set at $L+\sqrt{Rt}$ and the spacing of was provided between the end portions of the heating member 6 before and after its movement. Preferably, the spacing interval x between the end portions of the heating member 6 before and after its movement is preferably $\frac{1}{4}\cdot L<L+x<\sqrt{Rt}$ because the time needed to set up the heating member 6 increases and the operation efficiency is reduced when the distance covered by the movement of the heating member 6 is below $\frac{1}{4}\cdot L$. In the embodiment of the invention shown in FIG. 4 or 6 in which a plurality of heating members are used, the spacing interval y between the adjacent heating members 6 or the adjacent segments 6a of the heating member 6 is preferably $0<y<\sqrt{Rt}$.

EXAMPLE

A cylindrical structure made of 18–8 stainless steel having an inner diameter of 840 mm and a thickness of 40 mm was subjected to the heat treatment method embodying the invention. The weld of the structure was heated by the heating member 6 shown in FIG. 2 spaced 10~50 mm apart from the weld 5, the heating member was operated by 3 kHz and more than 300 kW, so that the outer surface of the structure opposing the heating member 6 became 500° C.±50° C. in temperature while the inner surface thereof in contact with cooling water became 100° C.~150° C. in temperature, which temperature condition was held in a period of time of 300 seconds. As the result, the improvement of the residual stress on the inner surface of the structure was successfully achieved.

What is claimed is:

1. A method of subjecting a welded structure to heat treatment in which a tensile yield is produced on an inner surface of the welded structure and a compressive yield is produced on an outer surface of the welded structure by the steps of placing a cooling medium in the interior of the welded structure and heating the outer surface of the welded structure to cause a difference in temperature to exist betweem the inner surface and the outer surface of the welded structure, the method comprising the steps of locally heating a weld by a plurality of heating members arranged along the weld to improve residual stress in a localized area of the weld, and repeating the improvement of residual stress in another localized area of the weld so that residual stress in the whole of the weld is improved.

2. A method of subjecting a welded structure to heat treatment as claimed in claim 1, wherein the interval y spacing the plurality of heating members apart from each other if $0<y<Rt$ (R, the mean radius of the welded structure; and t, the thickness of the wall of the welded structure).

3. A method of subjecting a welded structure to heat treatment in which a tensile yield is produced on an inner surface of the welded structure and a compressive yield if produced on an outer surface of the welded structure by the steps of placing a cooling medium in the interior of the welded structure and heating the outer surface of the welded structure to cause a difference in temperature to exist between the inner surface and outer surface of the welded structure, comprising the steps of locally heating a weld by means of a heating member to relieve stress in a localized area of the weld, and successively moving the heating member to successively heat localized areas of the weld, to thereby provide a continuation of the area where stress has been improved.

4. A method of subjecting a welded structure to heat treatment as claimed in claim 3, wherein the distance x covered by the movement of the heating member is $\frac{1}{4}\cdot L<x<L+Rt$ (L, the length of the heating member; R, the mean radius of the welded structure; and t, the thickness of the wall of the welded structure).

5. A method of subjecting a welded structure to heat treatment as claimed in claim 4 or 2, wherein the heat generation at end portions of the heating member is reduced below the heat generation at a central portion of the heating member.

6. A method of subjecting a welded structure to heat treatment as claimed in claim 5, wherein the heat generation at the end portions $\frac{1}{8}\cdot L-\frac{1}{3}\cdot L$ (L, the length of the heating member) of the heating member is reduced to 50–85% of the heat generation at the central portion of the heating member.

* * * * *